US007121901B1

(12) United States Patent
Chen

(10) Patent No.: US 7,121,901 B1
(45) Date of Patent: Oct. 17, 2006

(54) TERMINAL BLOCK EQUIPPED WITH A COVER

(75) Inventor: Michael Chen, Keelung (TW)

(73) Assignee: Surtec Industries Inc., Keelung (TW)

( * ) Notice: Subject to any disclaimer, the term of this patent is extended or adjusted under 35 U.S.C. 154(b) by 0 days.

(21) Appl. No.: 11/204,340

(22) Filed: Aug. 16, 2005

(30) Foreign Application Priority Data

Apr. 20, 2005 (TW) ..... 94206208 U

(51) Int. Cl.
*H01R 9/22* (2006.01)

(52) U.S. Cl. ..... 439/718

(58) Field of Classification Search ..... 439/718, 439/409, 922, 395, 814, 797–798, 908, 709; 174/138 F; 361/395, 391
See application file for complete search history.

(56) References Cited

U.S. PATENT DOCUMENTS 3,887,259 A 6/1975 Ayer
4,104,703 A 8/1978 Hotchkiss
4,538,868 A * 9/1985 Cruise et al. ..... 439/131
4,697,720 A 10/1987 Hotchkiss et al.
4,898,550 A 2/1990 Ayer
4,975,072 A * 12/1990 Afshar ..... 439/131
5,043,847 A * 8/1991 Deinhardt et al. ..... 361/736
5,156,551 A * 10/1992 Unger et al. ..... 439/49
6,497,592 B1 * 12/2002 Beadle ..... 439/814
6,630,637 B1 * 10/2003 Ward et al. ..... 200/17 R

* cited by examiner

*Primary Examiner*—J. F. Duverne
(74) *Attorney, Agent, or Firm*—Harness, Dickey & Pierce, PLC

(57) ABSTRACT

A terminal block equipped with a cover includes a cover and a terminal block. The terminal block has pivot plates on two sides. Each pivot plate has a coupling trough. The cover has an axle on one side, to be wedged in the coupling trough, so that the cover may be hinged on one side of the terminal block. The cover may be turned to shield the terminal block. Wedging of the axle in the coupling trough also forms an anchoring effect to position the cover on a correct location relative to the terminal block, so that the cover can fully shield the terminal block, to provide desired covering and protection.

17 Claims, 5 Drawing Sheets

TERMINAL BLOCK EQUIPPED WITH A COVER

BACKGROUND OF THE INVENTION

1. Field of Invention

The present invention relates to conductors for communication equipment. More particularly, The present invention relates to a terminal block equipped with a cover that includes a cover hinged on one side of the terminal block and anchored on a correct location to completely cover the terminal block.

2. Related Art

The terminal block is widely used in telecommunication systems to connect signal wires on one location to facilitate maintenance and management. U.S. Pat. No. 3,887,259 discloses such a connecting device, which has a rectangular terminal block made from an insulation material. The terminal block has a plurality of guiding plates on two longer sides that are spaced from one another to allow the signal wires to pass through. The signal wires may be divided according to different signal sources and classified according to their functions. The terminal block further has a plurality of terminals. Each terminal has a narrow slot to clip a signal wire, so that the signal wire and the terminal form an electric connection. The terminals may be connected in advance according to requirements. For instance, two or more terminals may be integrally formed by stamping, so that one end of the terminals is interconnected and the other end of the terminals runs through the bottom of the terminal block and extends outside the top surface of the terminal block. Or different terminals may be connected by jumpers. When there is a need to connect two signal wires, they may be coupled on the connected terminals to form electric connection. Moreover, connection of the signal wires may be expanded from two signal wires to multiple signal wires. For instance, to branch a signal source to a plurality of signal wires, multiple signal wires have to be interconnected, and the signal wires can pass through the same gap between two guiding plates for classification to facilitate identification during repairs and maintenance.

As the terminals are exposed on the top surface of the terminal block, they are easily hit by external articles and result in a shot circuit between the terminals, or result in disconnecting of the signal wires. Hence a cover has to be provided on the top surface of the terminal block to provide shielding and protection. The conventional cover adopts latch coupling, and has an edge or sidewall to engage outer sides of the guiding plates. For instance, U.S. Pat. No. 4,104,703 provides a terminal block cover, which is directly mounted onto a terminal block. It has snap tabs to latch on the top edge of the guiding plate. U.S. Pat. No. 4,898,550 discloses an extruded plastic hinge cover for terminal blocks that has a flexible strip coupled with a adjacent component and a cover. The adjacent component engages the guiding plates. The flexible strip functions like a hinge and the cover can be swiveled relative to the terminal block to cover the terminal block. U.S. Pat. No. 4,697,720 discloses a terminal block cover, which has a hinge mechanism that engages the terminal block's guiding plates, and an axle corresponding to the edge of the cover so that the cover can be swiveled relative to the terminal block.

However, U.S. Pat. Nos. 4,697,720, 4,104,703 and 4,898,550 previously discussed do not have an align mechanism in the longitudinal direction of the terminal block. Hence during installation of the cover on the terminal block, the relative position of the cover and the terminal block has to be adjusted and aligned accurately, to shield and protect all the terminals. A slight deviation could expose the terminals and result in being hit by external articles. As a result, a short circuit between the terminals or disconnecting of the signal wires still could happen.

SUMMARY OF THE INVENTION

In view of the aforesaid problems, the primary object of the present invention is to provide a terminal block equipped with a cover. The cover can be automatically aligned and hinged on the terminal block to shield and protect the terminals and signal wires on the terminal block. The cover also may be removed quickly to facilitate wiring and repairs and maintenance.

To achieve the foregoing object, the terminal block equipped with a cover according to the invention includes a terminal block, pivot plates and a cover. The terminal block has a plurality of terminals to connect signal wires on the top surface and a plurality of guiding plates on two sides. Each guiding plate has a top plate on the top end. The top plate has a flange extending outwards on a outer edge. There are two sets of pivot plates, and each set includes a pair of pivot plates. Each set of pivot plates is located on one side of the terminal block, and each one of the pivot plates is located between two guiding plates. Furthermore each pivot plate has a holding portion extended outwards from the terminal block. The holding portion has a coupling trough, which has an opening with a detent portion located thereon. The cover further has a plurality of axles on one side corresponding to each set of the pivot plates. The axle is wedged in the coupling trough. The flange of the top plate and the detent portion of the pivot plate can confine the axle so that the axle is held securely in the coupling trough without escaping and can rotate in the coupling trough. Therefore the cover can be swiveled relative to the terminal block and shield the terminal block to protect the terminals from being hit by external articles. Thus short circuit or disconnecting of the signal wires can be prevented.

As the relative position of the cover and the terminal block is aligned by coupling of the axle and the coupling trough, and the cover can be automatically hinged on one side of the terminal block on a correct position to cover the terminal block accurately. In addition, because the cover and the terminal block can be positioned accurately, labeling may be made on the corresponding positions of the cover to classify the terminals according to connecting conditions. Hence wiring operation is simpler and the signal wires of different connection may be identified easily.

The present invention can provide many advantages. For instance, as the pivot plate is a portion of the terminal block, it can be integrally formed on the terminal block to reduce the number of elements. Compared with U.S. Pat. No. 4,697,720, the present invention does not need to add extra hinge elements to hinge the cover on one side of the terminal block. Moreover, after the axle of the cover is wedged in the coupling trough, the cover and the terminal block are positioned on correct positions so that the cover can completely shield all terminals and provide desired protection. Exposure of terminals may be prevented. As the cover can be positioned on the correct location, labeling may be made on the cover to facilitate identification and classification of the terminals and signal wires.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given in the illustration below only, and thus are not limitative of the present invention, wherein.

DETAILED DESCRIPTION OF THE INVENTION

Figure 1A:
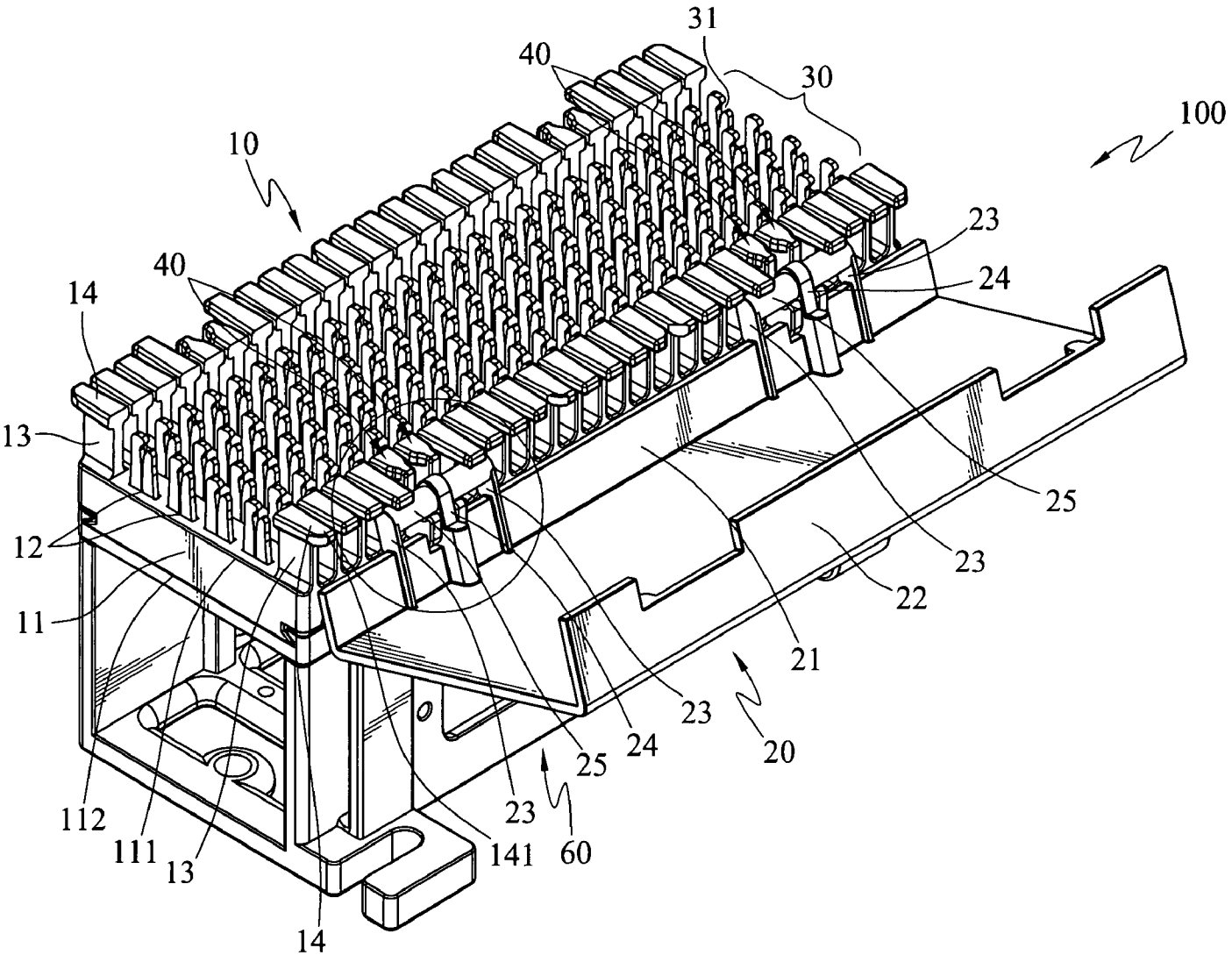
FIG. 1A is a perspective view of an embodiment of the present invention.
Figure 1B:
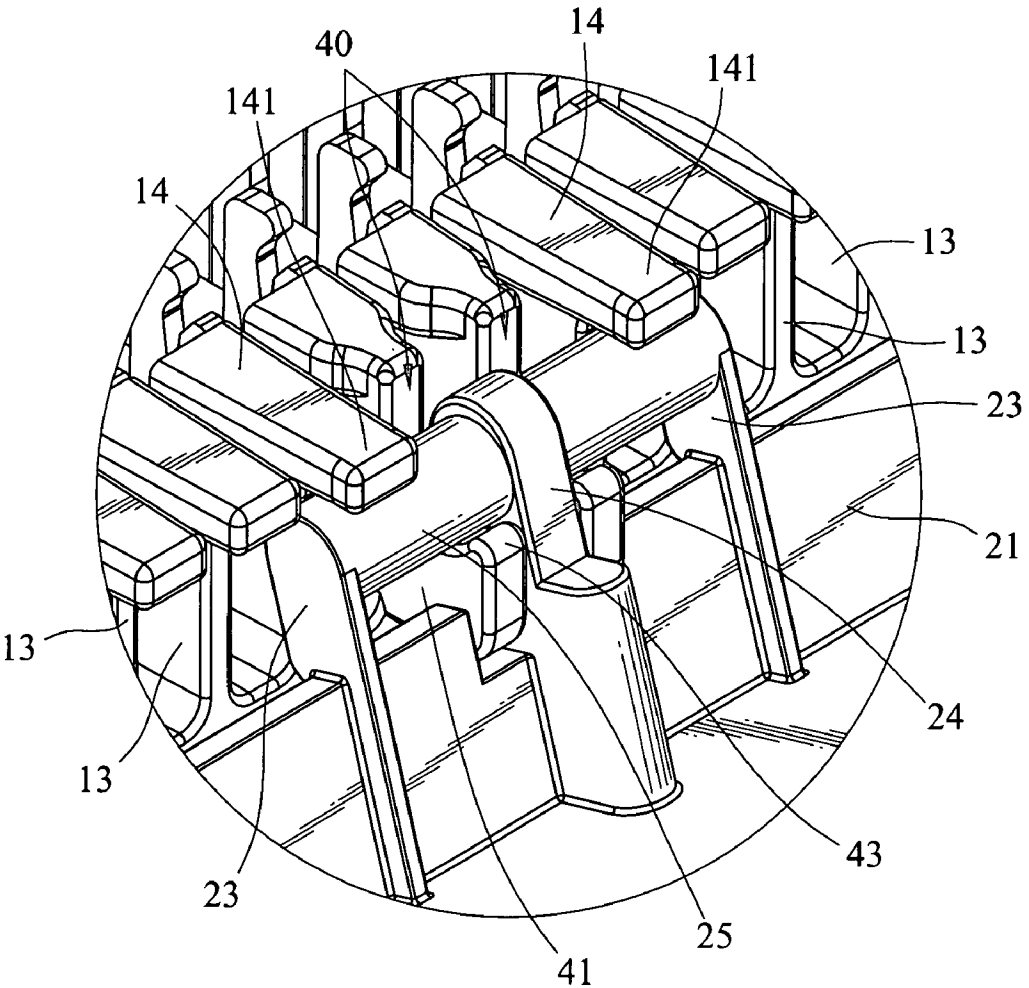
FIG. 1B is a fragmentary enlarged view according to FIG. 1A.
Figure 2:
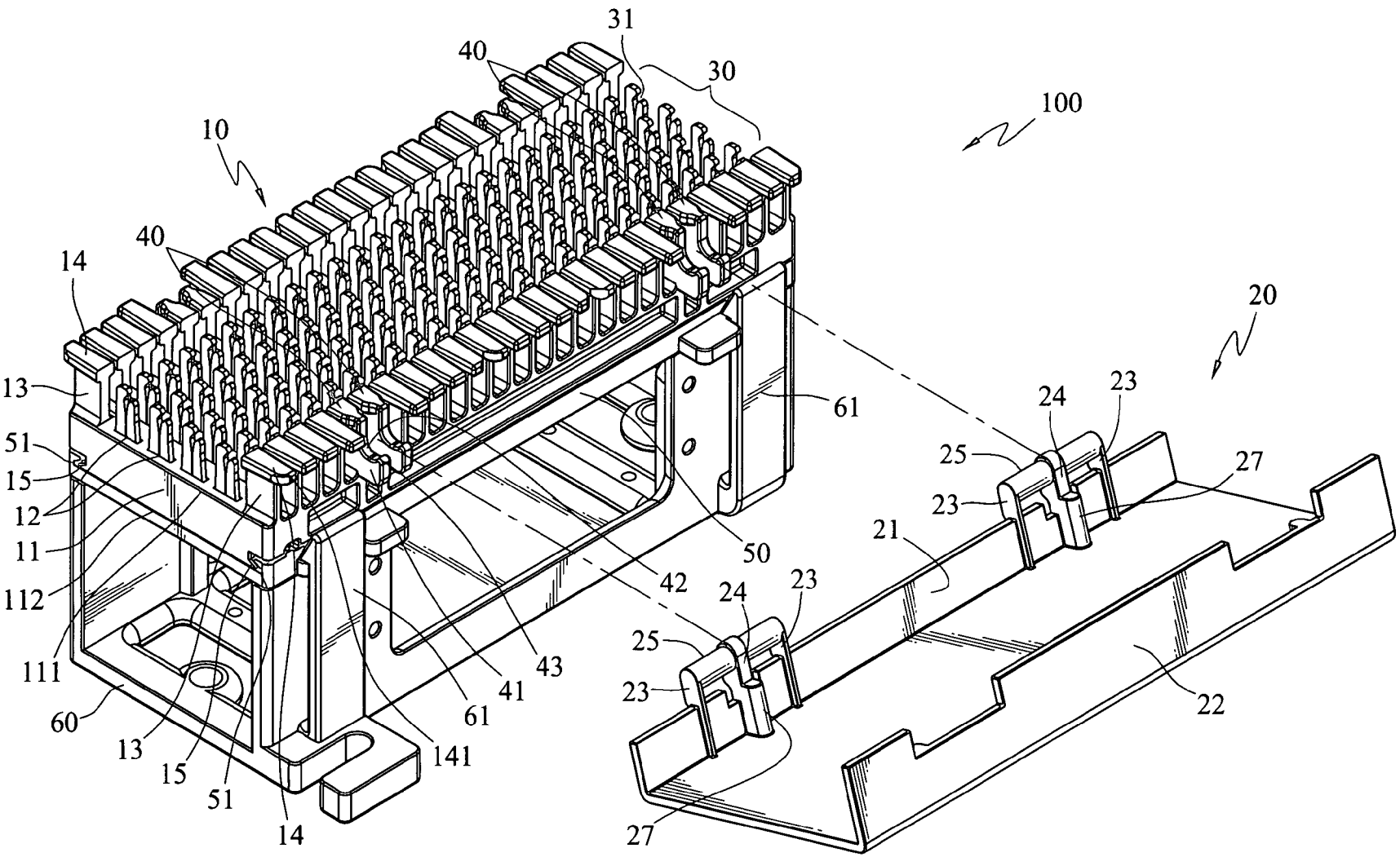
FIG. 2 is a perspective view of the present invention with the cover separating from the terminal block.

Refer to FIGS. 1A, 1B and 2 for an embodiment of the present invention. The connecting device 100 includes a terminal block 10 and a cover 20, which covers the upper side of the terminal block 10 to provide shielding and protection.

The terminal block 10 is a commonly used element in telecommunication. It is made from insulation materials, such as plastics. The terminal block 10 includes a body 11, which has a top surface 111 and a bottom surface 112. The top surface 111 has a plurality of insertion holes 12 to receive a plurality of terminals 30. The insertion holes 12 may be arranged in different layouts according to requirements. In this embodiment, the insertion holes 12 are laid in a plurality of rows in a spaced manner. Hence the terminals 30 also are arranged in a spaced manner on the body 11. Each terminal 30 has a slot 31 in the longer axial direction to clip a signal wire (not shown in the drawings) to form an electric connection between the signal wire and the terminal 30. The body 11 has two longer sides, which have a plurality of guiding plates 13 located thereon. Each guiding plate 13 has a top plate 14 on the topside, which is vertical to the guiding plate 13 and extended towards two lateral sides, such, that the guiding plate 12 and the top plate 14 form a T-shape cross section. The top plate 14 has an edge extended outwards to form a flange 141. The signal wire has one end clipped by the slot 31 of the terminal 30 and another end passing through the interval between the guiding plates 13, and is extended outside the terminal block 10. In practice, the interval between the guiding plates 13 varies according to effects to be achieved, to allow different numbers of signal wires to pass through. One interval can correspond to one row of terminals 30 or a plurality of rows of terminals 30. In this embodiment, the intervals between guiding plates 13 are identical and correspond to one row of terminals 30. The top surface 111 has a longer side, which has plurality sets of pivot plates 40 to replace the guiding plate 13. The pivot plate 40 has an upper portion formed at a width narrower than the guiding plate 13, and a lower portion extended outwards to form a holding portion 41. The holding portion 41 has a coupling trough 42 formed in arched shape which has an opening with a detent portion 43 formed on an edge. The pivot plate 40 also has a top plate 44 but does not have an extending flange. In this embodiment, each set of the pivot plate 40 includes a pair of pivot plates 40. The longer side of the top surface 111 has two sets of the pivot plate 40. Namely there are four pivot plates 40 on the longer side of the top surface 111 to replace the guiding plates 13. The two longer sides of the body 11 have the pivot plates 40 located thereon to be selectively used according to requirements. The body 11 is mounted onto a baseboard 50. The bottom surface 112 of the body 11 and the baseboard 50 have respectively a guiding trough 15 and a guiding track 51 matching each other to enable the body 11 to be anchored on the baseboard 50. The baseboard 50 is fastened to an anchor rack 60, which is latched on the baseboard 50 through a plurality of latch hooks 61. The anchor rack 60 further has a plurality of lugs 62 to fasten the anchor rack 60 to a flat surface so that the connecting device 100 equipped with a cover can be mounted onto a desired location.

The cover 20 is formed in a geometric shape at a dimension matching the body 11 to fully cover the top surface 111 of the body 11. The cover 20 has two longer sides extended respectively to form a first side wall 21 and a second side wall 22 corresponding to the outer sides of the guiding plates 13 on the two longer sides of the body 11. Hence when the cover 20 covers the body 11, the first side wall 21 and the second side wall 22 are engaged with the outer sides of the guiding plates 13 to shield the terminals 30 and provide protection. Thus a short circuit, or disconnecting of the signal wires caused by the terminals 30 hit by external articles can be prevented. The first side wall 21 has two first suspending arms 23 and one second suspending arm 24 on one side corresponding to each set of the pivot plates 40. The second suspending arm 24 is located between the two first suspending arms 23. There is an axle 25, which has two ends connecting to the two first suspending arms 23. The second suspending arm 24 is coupled on the axle 25 in the middle portion. The axle 25 is parallel with first sidewall 21. The axle 25 is wedged in the coupling trough 43 of the pivot plate 40. The detent portion 44 and the flange 141 of the top plate 14 of the guiding plate 13 can prevent the axle 25 from escaping from the opening of the coupling trough 43. The two first suspending arms 23 are located between two pivot plates 40 and the abutting guiding plates 13. The second suspending arm 24 is located between the two pivot plates 40. The axle 25 may rotate on the holding portion 41 so that the cover 20 is hinged on one side of the body 11 and may be swiveled relative to the body 11. The cover 20 may be swiveled relative to the body 11 to cover the body 11, or form an angle with the body 11 to expose the top surface of the body 11. The axle 25 may also be removed from the coupling trough 43 by force to separate the cover 20 from the body 10. The two first suspending arms 13, second suspending arm 14 and the axle 25 are formed to match the pivot plates 40. In this embodiment, each longer side of the terminal block 10 has two sets of pivot plates 40. Hence the cover 20 needs two axles 25 to be coupled respectively with different first suspending arms 23 and second suspending arms 24 corresponding to the pivot plates 40. Therefore the two axles 25 can be wedged in different coupling troughs 43. Once the axles 25 have been wedged in the coupling troughs 43, an anchoring effect also is formed. Therefore the cover 20 can be coupled on the terminal block 10 on the correct position. After the cover 20 is turned and close to the body 11, it fully covers the top surface 111 of the body 11 to shield all the terminals 30 without exposing. As the pivot plates 40 are located on two longer sides of the body 11, the axles 25 can be wedged in different coupling troughs 43 according to requirements, so that the cover 20 can be hinged on different sides of the body 11.

The second side wall 22 has a latch element 26 on an inner side close to the edge. When the cover 20 covers the body 11, the latch element 26 is latched on a lower side of the flange 141 of the top plate 14 to anchor the cover 20 so that the cover 20 does not turn freely relative to the terminal block 10, to maintain the shielding condition of the cover 20 on the body 11.

Figure 3A:
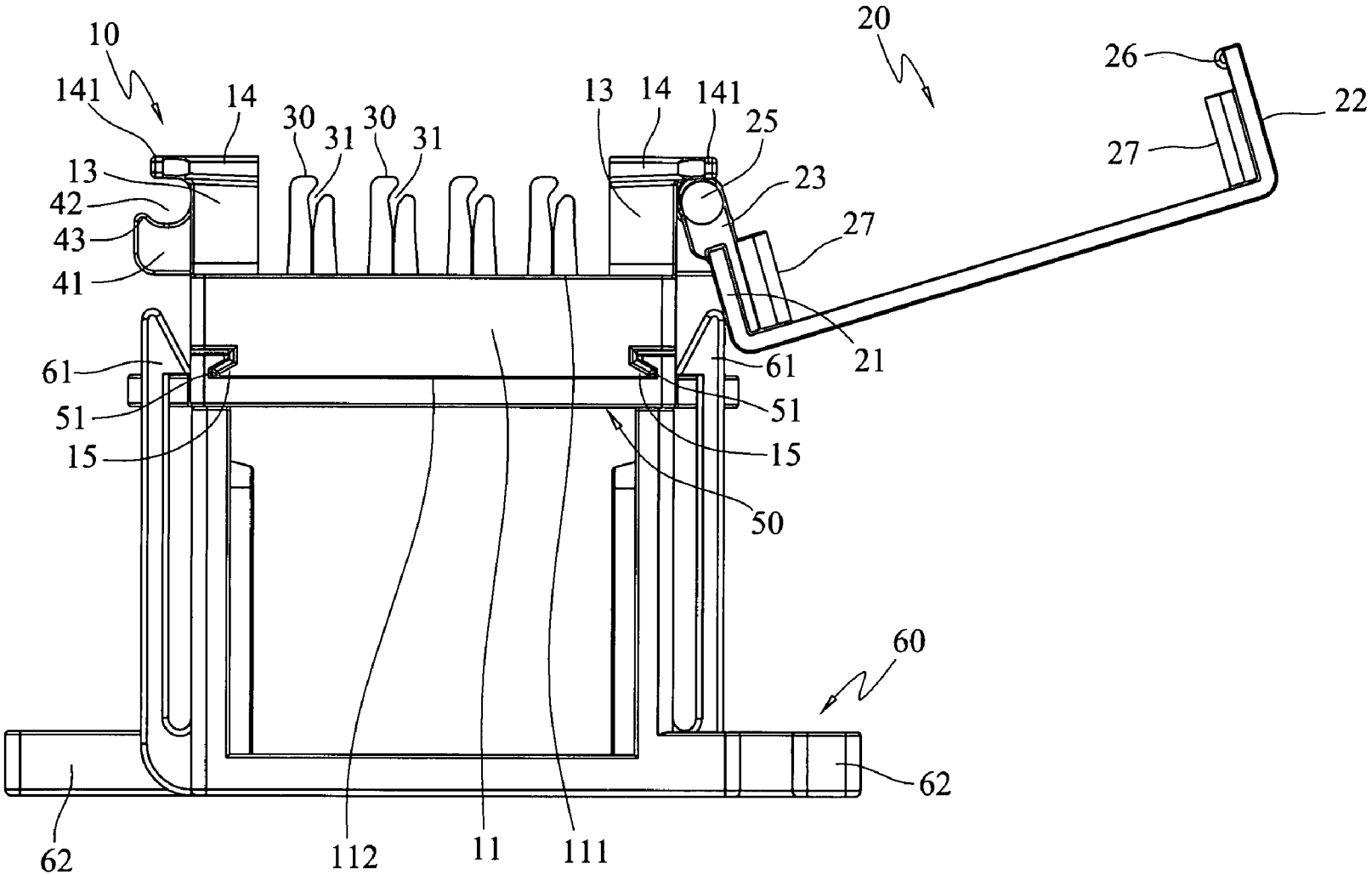
FIGS. 3A and 3B are schematic side views of an embodiment of the invention with the cover in opening and closed condition, relative to the terminal block.
Figure 3B:
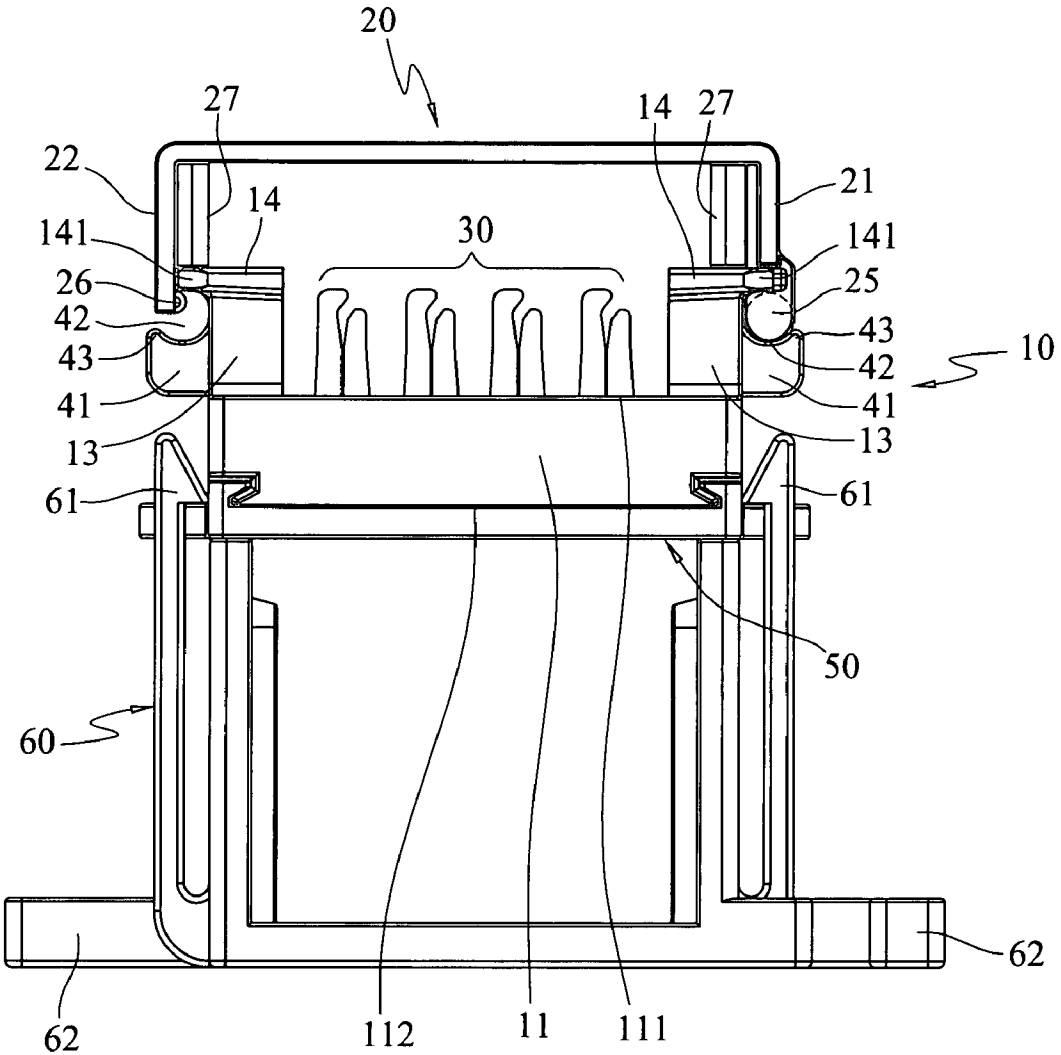

Referring to FIGS. 3A and 3B, the cover 20 is hinged on one longer side of the terminal block 10 and may swivel relative to the terminal block 10. Hence the cover 20 may be moved close to the terminal block 10 or opened. The pivot plate 40 and the axle 25 may also function like a latch mechanism. When there is a need to do repairs and maintenance for the connection lines, the cover 20 may be separated from the terminal block 10. After the repairs and maintenance are finished, the axle 25 may be wedged in the coupling trough 43, and the latch element 26 may be depressed below the flange 141 of the top plate 14 to anchor the cover 20 on the terminal block 10, to cover the body 11.

To install the cover 20 on the terminal block 10, first, wedge the axle 25 in the corresponding coupling trough 43 to automatically hinge the cover 20 on one side of the body 11, so that the cover 20 is located on the correct position of the terminal block 10. Then the cover 20 may be swiveled and fully shield the body 11 without skewing and protect the terminals 30 without exposing. The operation is simpler and does not need to do adjustment of the cover 20 on the body 11 that often occurs to conventional techniques.

Moreover, the coupling relationship between the coupling trough 43 and the axle 25 creates an anchoring effect for the cover 20. Hence different labels (not shown in the drawings) may be made on the cover 20 corresponding to different terminals 30, signal wires or intervals between the guiding plates 13 on the terminal block 10 according to different signal sources. Thereby, the terminals 30 and signal wires can be identified easily.

To prevent the cover 20 from contacting with the top end of the terminals 30 or signal wires, the inner side of the cover 20 may be formed with a plurality of spacers 27. When the cover 20 covers the body 11, the spacers 27 locate the top plates 14 of the guiding plates 13 so that the cover 20 is spaced from the top end of the terminals 30 at a predetermined distance. Thereby, the cover 20 is not in contact with the terminals 30, deformation of the terminals 30 can be prevented and disconnecting of the signal wires can be avoided.

Knowing the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A terminal block equipped with a cover, comprising:

a terminal block having two opposing sides each having a plurality of guiding plates;

at least one pivot plate having a coupling trough, and extended outwards from one side of the terminal block between two guiding plates; and a cover having an axle located on one side to be wedged in the coupling trough and automatically aligned and hinged on one side of the terminal block so that the cover is swiveled relative to the terminal block to cover the terminal block;

wherein the cover has two longer sides extended respectively to form a first side wall and a second sidewall, the first side wall having a second suspending arm on one side, the axle having a middle portion connecting to the second suspending arm.

2. The terminal block equipped with a cover of claim 1, wherein the terminal block has a plurality of insertion holes to receive a plurality of terminals.

3. The terminal block equipped with a cover of claim 2, wherein the cover shields all the terminals and the insertion holes after covering the terminal block.

4. The terminal block equipped with a cover of claim 2, wherein each of the terminals has a slot formed in the direction of a longer axis of the terminal.

5. The terminal block equipped with a cover of claim 1, wherein each of the guiding plates has a top plate on the top end vertical to the guiding plate and being extended outwards.

6. The terminal block equipped with a cover of claim 5, wherein the top plate has a flange extended outwards from a outer edge.

7. The terminal block equipped with a cover of claim 1, wherein the terminal block includes a pair of guiding plates.

8. The terminal block equipped with a cover of claim 1, wherein the pivot plate has an upper portion formed in a width narrower than the guiding plates.

9. The terminal block equipped with a cover of claim 1, wherein the coupling trough is formed in an arched shape.

10. The terminal block equipped with a cover of claim 1, wherein the coupling trough has an opening which has a detent portion formed on one edge thereof.

11. The terminal block equipped with a cover of claim 1, wherein the pivot plate has a holding portion extended outwards, the coupling trough being located on the holding portion.

12. The terminal block equipped with a cover of claim 1, wherein the first side wall has a first suspending arm on one side, the axle having one end connecting to the first suspending arm.

13. The terminal block equipped with a cover of claim 1, wherein the first side wall has two first suspending arms on one side, the axle having two ends connecting to the first suspending arms.

14. The terminal block equipped with a cover of claim 1, wherein the terminal block is anchored on a baseboard.

15. The terminal block e equipped with a cover of claim 14, wherein the baseboard is fastened to an anchor rack.

16. The terminal block equipped with a cover of claim 15, wherein the anchor rack has a plurality of lugs to be fastened to a flat surface.

17. A terminal block equipped with a cover, comprising:

a terminal block having two opposing sides each having a plurality of guiding plates;

at least one pivot plate having a coupling trough, and extended outwards from one side of the terminal block between two guiding plates; and a cover having an axle located on one side to be wedged in the coupling trough and automatically aligned and hinged on one side of the terminal block so that the cover may be swiveled relative to the terminal block to cover the terminal block;

wherein the pivot plate has a upper portion formed in a width narrower than the guiding plates.

* * * * *